US011738567B2

(12) United States Patent
Hart et al.

(10) Patent No.: US 11,738,567 B2
(45) Date of Patent: Aug. 29, 2023

(54) PRINTER AND METHOD

(71) Applicant: VIDEOJET TECHNOLOGIES INC., Wood Dale, IL (US)

(72) Inventors: Philip Hart, Nottingham (GB); Jeremy Ellis, Nottingham (GB)

( * ) Notice: Subject to any disclaimer, the term of this patent is extended or adjusted under 35 U.S.C. 154(b) by 18 days.

(21) Appl. No.: 16/436,007

(22) Filed: Jun. 10, 2019

(65) Prior Publication Data

US 2019/0291462 A1 Sep. 26, 2019

Related U.S. Application Data

(63) Continuation of application No. 15/523,124, filed as application No. PCT/GB2015/053285 on Oct. 30, 2015, now Pat. No. 10,315,437.

(30) Foreign Application Priority Data

Oct. 31, 2014 (GB) ..... 1419465

(51) Int. Cl.
*B41J 2/32* (2006.01)
*B41J 2/325* (2006.01)
(Continued)

(52) U.S. Cl.
CPC ..... *B41J 2/325* (2013.01); *B41J 17/06* (2013.01); *B41J 17/07* (2013.01); *B41J 33/16* (2013.01);
(Continued)

(58) Field of Classification Search
None
See application file for complete search history.

(56) References Cited

U.S. PATENT DOCUMENTS 4,025,830 A 5/1977 Delaporte
5,157,413 A * 10/1992 Nagato ..... B41J 2/325 400/232
5,274,544 A 12/1993 Iida
5,380,394 A 1/1995 Shibuya et al.
(Continued)

FOREIGN PATENT DOCUMENTS

CN 1041564 A 4/1990
CN 1185769 A 6/1998
(Continued)

OTHER PUBLICATIONS

PCT/GB2015/053285; International Search Report and Written Opinion; dated Apr. 8, 2016, 13 pages.

*Primary Examiner* — Erica S Lin
*Assistant Examiner* — Tracey M McMillion
(74) *Attorney, Agent, or Firm* — Wolter Van Dyke Davis, PLLC; Robert L. Wolter

(57) ABSTRACT

A method of operating a thermal transfer printer, the thermal transfer printer comprising first and second spool supports each being configured to support a spool of ribbon; a ribbon drive configured to cause movement of ribbon from the first spool support to the second spool support along a predetermined ribbon path; and a printhead. The printhead is moveable towards and away from a printing surface, and, during printing, is configured to selectively transfer ink from the ribbon to a substrate as the substrate and printhead are moved relative to one another at a print speed. The method comprising causing relative movement between the ribbon and the printhead at a ribbon speed. A relative speed of movement between the ribbon and the substrate during printing is controlled based upon a force exerted upon the ribbon by the printhead during a printing operation, and/or a parameter indicative of an area of contact between a portion of the printhead and a portion of the printing surface.

20 Claims, 3 Drawing Sheets

(51) Int. Cl.

| | |
|---|---|
| ***B41J 17/06*** | (2006.01) |
| ***B41J 17/07*** | (2006.01) |
| ***B41J 33/34*** | (2006.01) |
| ***B41J 33/38*** | (2006.01) |
| ***B41J 33/16*** | (2006.01) |
| *B41J 25/312* | (2006.01) |
| *B41J 33/36* | (2006.01) |
| *B41J 35/36* | (2006.01) |

(52) U.S. Cl.
CPC ..... *B41J 33/34* (2013.01); *B41J 33/38* (2013.01); *B41J 25/312* (2013.01); *B41J 33/36* (2013.01); *B41J 35/36* (2013.01)

(56) References Cited

U.S. PATENT DOCUMENTS

| | | | | |
|---|---|---|---|---|
| 5,816,719 | A * | 10/1998 | Palmer | B41J 17/14 400/232 |
| 5,846,002 | A | 12/1998 | Buckby et al. | |
| 2007/0252888 | A1* | 11/2007 | McNestry | B41J 2/32 347/215 |
| 2013/0215210 | A1* | 8/2013 | McNestry | B41J 25/312 347/214 |

FOREIGN PATENT DOCUMENTS

| | | | |
|---|---|---|---|
| EP | 0329478 | A2 | 8/1989 |
| EP | 2823965 | A1 | 1/2015 |
| JP | H0699630 | A | 4/1994 |
| WO | 2013025746 | A | 2/2013 |
| WO | 2013025746 | A1 | 2/2013 |

* cited by examiner

PRINTER AND METHOD

The present invention relates to a method of operating a transfer printer, and more particularly, but not exclusively to a method of operating a thermal transfer printer.

Thermal transfer printers use an ink carrying ribbon. In a printing operation, ink carried on the ribbon is transferred to a substrate which is to be printed. To effect the transfer of ink, the printhead is brought into contact with the ribbon, and the ribbon is brought into contact with the substrate. The printhead contains printing elements which, when heated, whilst in contact with the ribbon, cause ink to be transferred from the ribbon and onto the substrate. Ink will be transferred from regions of the ribbon which are adjacent to printing elements which are heated. An image can be printed on a substrate by selectively heating printing elements which correspond to regions of the image which require ink to be transferred, and not heating printing elements which correspond to regions of the image which require no ink to be transferred.

The printing elements are generally arranged in a linear array. By causing relative movement between the printhead and the substrate on which printing is to occur, an image can be printed by carrying out a series of printing operations, each printing operation comprising the energisation of none, some or all of the printing elements to print a 'line' of the desired image before the relative movement is caused. A further 'line' is then printed in a next printing operation. A plurality of lines printed in this way together form the whole of the desired image.

Thermal transfer printers make use of single use ribbon. Thus, in order to provide new ribbon for each printing operation, the ribbon is transferred from a first spool, often referred to a supply spool, to a second spool, often referred to as a take-up spool, past the print head, i.e. there is also relative movement between the ribbon and the printhead. In conventional printing, the relative movement between the ribbon and the printhead, and between the substrate and the printhead, is arranged to be carried out at a common speed i.e. the printhead-substrate and printhead-ribbon speeds are controlled to be substantially the same.

It is an object of some embodiments of the present invention to provide a method of operating a transfer printer. In particular, some embodiments provide a method of operating a thermal transfer printer in which ribbon is controlled to be transferred between the spools without substantial distortion.

According to a first aspect of the invention, there is provided a method of operating a thermal transfer printer, the thermal transfer printer comprising: first and second spool supports each being configured to support a spool of ribbon; a ribbon drive configured to cause movement of ribbon from the first spool support to the second spool support along a predetermined ribbon path; and a printhead, the printhead being moveable towards and away from a printing surface, and, during printing, being configured to selectively transfer ink from the ribbon to a substrate as the substrate and printhead are moved relative to one another at a print speed; the method comprising causing relative movement between the ribbon and the printhead at a ribbon speed. The ribbon speed may be less than the print speed and greater than or equal to about 90% of the print speed.

By controlling the ribbon such that it moves more slowly relative to the printhead than does the substrate, there is caused to be some relative movement between the ribbon and the substrate, in addition to the relative movement between the substrate and the printhead, and between the ribbon and the printhead. In other words, the ribbon is moved at a 'reduced speed' compared to the substrate. Such 'reduced speed' ribbon movement during a printing operation provides for improved ribbon control, and hence reduced ribbon trauma, resulting in improved print quality when compared to 'full speed' ribbon movement.

This method can be contrasted with known techniques in which a ribbon is moved substantially more slowly than the substrate, bringing about a significant degradation in print quality, so as to achieve a reduced ribbon usage. That is, in such known techniques print quality is sacrificed at the expense of ribbon usage efficiency, with an acceptable compromise in both being found for each printing arrangement. Typically techniques involve a ribbon speed of about half of a substrate speed, or less.

The method provided by the first aspect of the invention, on the other hand, in fact provides an improvement in print quality. This improvement is enabled by the surprising realisation that reducing the ribbon speed with respect to the substrate speed leads to reduced ribbon distortion.

The ribbon speed may be controlled to be a percentage of the print speed. Preferably the ribbon speed is greater than or equal to about 92%. More preferably the ribbon speed is greater than or equal to about 95% of the print speed and less than or equal to about 99% of the print speed. For example the ribbon speed may have a value which is about 95% of the print speed, about 96% of the print speed about 98% of the print speed or about 99% of the print speed.

The ribbon speed may be controlled to be a percentage of the print speed. However, the ribbon speed need not be expressed as a percentage of the print speed but can instead be selected so as to be slower than the print speed and to have an approximate relationship with the print speed as noted above. For example ribbon speeds associated with particular print speeds may be predetermined and used as required.

The method may further comprise controlling a relative speed of movement between the ribbon and the substrate during printing.

The relative speed of movement between the ribbon and the substrate may be controlled based upon a force exerted upon the ribbon by the printhead during a printing operation.

The relative speed of movement between the ribbon and the substrate may be controlled based upon a parameter indicative of an area of contact between a portion of the printhead and a portion of the printing surface.

The ribbon speed may be controlled based upon a force exerted upon the ribbon by the printhead during a printing operation.

The ribbon speed may be controlled based upon a parameter indicative of an area of contact between a portion of the printhead and a portion of the printing surface.

The method may comprise: obtaining the print speed during a printing operation;

generating a ribbon drive control signal based upon the obtained speed.

The method may comprise: obtaining first data indicating a relationship between the print speed and the ribbon speed; and generating a ribbon drive control signal based upon said obtained data.

The method may comprise: obtaining second data indicative of a force exerted upon the ribbon by the printhead during a printing operation; generating a ribbon drive control signal based upon said second data.

The method may comprise: obtaining third data indicating a relationship between the force exerted upon the ribbon by the printhead and the ribbon speed; and generating a ribbon drive control signal based upon said third data.

The second data may be obtained based upon the print speed.

The method may comprise: causing the printhead to contact the ribbon while there is relative movement between the ribbon and the printhead at an initial ribbon speed, the initial ribbon speed being substantially equal to the print speed; and causing ink to be selectively transferred from the ribbon to the substrate while there is relative movement between the ribbon and the printhead at the ribbon speed.

The method may comprise: causing relative movement between the ribbon and the printhead at the initial ribbon speed; causing the printhead to contact the ribbon while there is relative movement between the ribbon and the printhead at the initial ribbon speed; causing relative movement between the ribbon and the printhead at the ribbon speed; and causing ink to be selectively transferred from the ribbon to the substrate while there is relative movement between the ribbon and the printhead at said ribbon speed.

The method may comprise: when ink has been transferred from the ribbon to the substrate, causing the printhead to remain in contact with the ribbon while speed of relative movement between the ribbon and the printhead is adjusted so as to be substantially equal to the print speed.

The force exerted by the printhead on the ribbon may be varied while the printhead remains in contact with the ribbon. More specifically, the force exerted by the printhead on the ribbon may be reduced while the printhead remains in contact with the ribbon.

The method may comprise controlling the ribbon drive to transport a length of ribbon between the spools, wherein the length of ribbon is based upon a length of an image printed on the substrate, and an image length compensation factor.

The image length compensation factor may be intended to compensate for a difference in an image length between a relaxed state and a stretched state.

A proportional difference between the length of ribbon and the length of the printed image may be less than a proportional difference between the ribbon speed and the print speed.

The method may comprise generating a control signal, the control signal causing a series of activations of the printhead, each activation causing the printing of a line of an image, wherein the control signal is based upon a modified ribbon speed, the modified ribbon speed being based upon the ribbon speed and the print speed.

According to a second aspect of the invention there is provided a method of operating a thermal transfer printer, the thermal transfer printer comprising: first and second spool supports each being configured to support a spool of ribbon; a ribbon drive configured to cause movement of ribbon from the first spool support to the second spool support along a predetermined ribbon path; and a printhead, the printhead being moveable towards and away from a printing surface, and, during printing, being configured to selectively transfer ink from the ribbon to a substrate as the substrate and printhead are moved relative to one another at a print speed; the method comprising causing relative movement between the ribbon and the printhead at a ribbon speed, wherein the ribbon speed is less than the print speed; and wherein the ribbon speed is controlled based upon a force exerted upon the ribbon by the printhead during a printing operation.

By controlling the ribbon such that it moves more slowly relative to the printhead than does the substrate, by an amount which is based on the force exerted by the printhead on the ribbon, print quality can be improved. That is, variations in printhead force can cause distortion or sagging in ribbon between the supply spool and the printhead, to an extent which is determined, at least in part, by the printhead force. By varying the relative speed of the ribbon and the substrate such distortion and sagging, and consequent print quality degradation, can be reduced.

According to a further aspect of the invention there is provided a method of operating a thermal transfer printer, the thermal transfer printer comprising: first and second spool supports each being configured to support a spool of ribbon; a ribbon drive configured to cause movement of ribbon from the first spool support to the second spool support along a predetermined ribbon path; and a printhead, the printhead being moveable towards and away from a printing surface, and, during printing, being configured to selectively transfer ink from the ribbon to a substrate as the substrate and printhead are moved relative to one another at a print speed; the method comprising causing relative movement between the ribbon and the printhead at a ribbon speed, wherein the ribbon speed is less than the print speed and wherein the print quality is improved relative to a printing operation in which the ribbon speed is substantially equal to the print speed.

It will be appreciated that features discussed in the context of one aspect of the invention can be applied to other aspects of the invention. In particular, where features are described as being used in combination with the method of the first aspect of the invention it will be appreciated that such features can also be used in combination with a method according to the second aspect of the invention.

The method of the first aspect of the invention can be carried out in any convenient way. In particular the method may be carried out by a printer controller and such a printer controller is therefore provided by the invention. The controller may be provided by any appropriate hardware elements. For example the controller may be microcontroller which reads and executes instructions stored in a memory, the instructions causing the controller to carry out a method as described herein. Alternatively the controller may take the form of an ASIC or FPGA.

A further aspect of the invention provides a thermal transfer printer comprising: first and second spool supports each being configured to support a spool of ribbon; and a ribbon drive configured to cause movement of ribbon from the first spool support to the second spool support; a printhead configured to selectively transfer ink from the ribbon to a substrate, and a controller of the type described in the preceding paragraph. The thermal transfer printer may comprise first and second motors each being arranged to drive a respective one of the first and second spool supports.

The methods described above can be implemented in any convenient form. As such the invention also provides computer programs which can be executed by a processor of a thermal printer so as to cause a printhead of the thermal printer to be controlled in the manner described above. Such computer programs can be stored on computer readable media such as non-tangible, not transitory computer readable media.

Features discussed above in the context of the first aspect of the invention can be applied to other aspects of the invention.

Embodiments of the invention are now described, by way of example, with reference to the accompanying drawings, in which.

Figure 1:
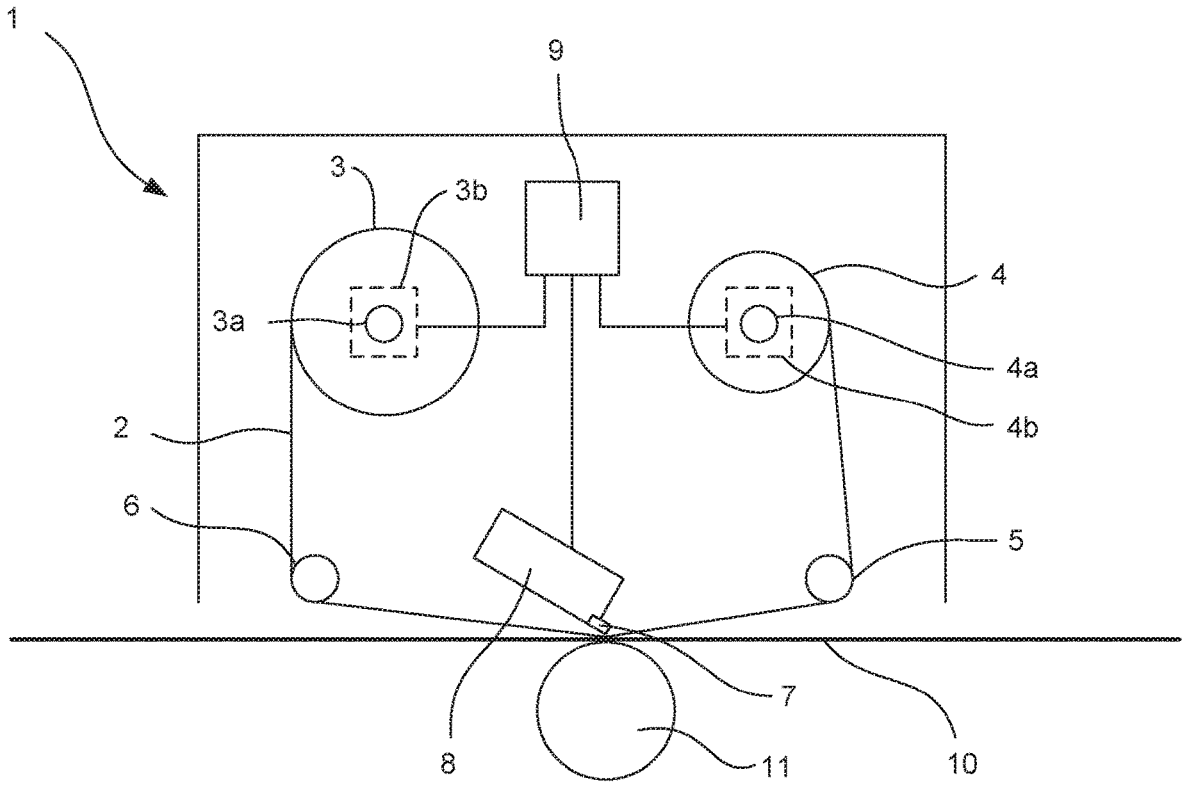
FIG. 1 is a schematic illustration of a thermal transfer printer according to embodiments of the invention.

Referring to FIG. 1, a thermal transfer printer 1 comprises an ink carrying ribbon 2 which extends between two spools, a supply spool 3 and a takeup spool 4. In use, ribbon 2 is transferred from the supply spool 3 to the takeup spool 4 around rollers 5, 6, past print head 7 mounted to a printhead carriage 8. The supply spool 3 is mounted on a spool support 3*a* which is driven by a supply spool motor 3*b*. Similarly, the take-up spool 4 is mounted on a take-up spool support 4*a* which is driven by a take-up spool motor 4*b*. Each of the supply spool motor 3*b* and the take up spool motor 4*b* are controlled by a printer controller 9. In the embodiment described here each of the supply spool motor 3*b* and the take-up spool motor 4*b* are hybrid stepper motors (as opposed to variable reluctance or permanent magnet stepper motors). The use of a hybrid stepper motor is preferred as it gives a higher resolution (typically 1.8 degrees per full step) than other types of stepper motor, and can operate at high stepping rates with excellent holding and dynamic torque capability. The stepper motor may be for example a Portescap motor having part number 34H118D30B.

While during operation the ribbon 2 is generally transferred from the supply spool 3 to the take-up spool 4, the controller 9 can also energise the motors so as to cause the ribbon 2 to be transferred from the take-up spool 4 to the supply spool 3. This can be useful in some printing modes as is described further below.

The rollers 5, 6 may be idler rollers, and serve to guide the ribbon 2 along a predetermined ribbon path as shown in FIG. 1.

In a printing operation, ink carried on the ribbon 2 is transferred to a substrate 10 which is to be printed on. To effect the transfer of ink, the print head 7 is brought into contact with the ribbon 2. The ribbon 2 is also brought into contact with the substrate 10, which is pressed against a platen roller 11. The print head 7 may be caused to move towards the ribbon 2 by movement of the print head carriage 8, under control of the printer controller 9. The print head 7 comprises printing elements arranged in a one-dimensional linear array, which, when heated, whilst in contact with the ribbon 2, cause ink to be transferred from the ribbon 2 and onto the substrate 10. Ink will be transferred from regions of the ribbon 2 which correspond to (i.e. are aligned with) printing elements which are heated. The array of printing elements can be used to effect printing of an image on to the substrate 10 by selectively heating printing elements which correspond to regions of the image which require ink to be transferred, and not heating printing elements which require no ink to be transferred.

A two dimensional image may be printed by printing a series of lines, the printing of each line being referred to as a printing operation. Different printing elements within the array may be heated during the printing of each line (i.e. during each printing operation). Between the printing of each line, the printhead 7, ribbon 2, and substrate 10 are moved with respect to each other, such that the line printed on the substrate 10 from one printing operation is adjacent to the line printed by the next printing operation.

There are generally two modes in which the printer of FIG. 1 can be used, which are sometimes referred to as a 'continuous' mode and an 'intermittent mode'. In both modes of operation, the apparatus performs a regularly repeated series of printing cycles, each cycle including a printing phase during which ink is transferred to the substrate 10, and a further non-printing phase during which the printer is prepared for the printing phase of the next cycle. A printing cycle may include a plurality of printing operations, one printing cycle resulting in an image being printed, the image comprising a plurality of printed lines, each line resulting from a respective printing operation.

In continuous printing, during the printing phase the print head 7 is brought into contact with the ribbon 2, the other side of which is in contact with the substrate 10 onto which an image is to be printed. The print head 7 is held stationary during this process—the term "stationary" is used in the context of continuous printing to indicate that although the print head will be moved into and out of contact with the ribbon, it will not move relative to the ribbon path in the direction in which ribbon is advanced along that path. Both the substrate 10 and ribbon 2 are transported past the print head. Conventionally, the substrate 10 and ribbon 2 are transported past the print head at substantially the same speed.

Generally only relatively small lengths of the substrate 10 which is transported past the print head 7 are to be printed upon and therefore to avoid gross wastage of ribbon it is necessary to reverse the direction of travel of the ribbon between printing cycles. Thus in a typical printing process in which the substrate is traveling at a constant velocity, the print head is extended into contact with the ribbon only when the print head 7 is adjacent regions of the substrate 10 to be printed. Immediately before extension of the print head 7, the ribbon 2 is accelerated up to for example the speed of travel of the substrate 10. The ribbon speed is then maintained at the constant speed of the substrate during the printing phase and, after the printing phase has been completed, the ribbon 2 is decelerated and then driven in the reverse direction so that the used region of the ribbon is on the upstream side of the print head. As the next region of the substrate to be printed approaches, the ribbon 2 is then be accelerated back up to the normal printing speed and the ribbon 2 positioned so that an unused portion of the ribbon 2 close to the previously used region of the ribbon is located between the print head 7 and the substrate 10 when the print head 7 is advanced to the printing position. It is therefore desirable that the supply spool motor 3*b* and the take-up spool motor 4*b* can be controlled to accurately locate the ribbon so as to avoid a printing operation being conducted when a previously used portion of the ribbon is interposed between the print head 7 and the substrate 10.

In intermittent printing, a substrate is advanced past the print head 7 in a stepwise manner such that during the printing phase of each cycle the substrate 10 and generally but not necessarily the ribbon 2 are stationary. Relative movement between the substrate 10, the ribbon 2 and the print head 7 are achieved by displacing the print head 7 relative to the substrate and ribbon. Between the printing phases of successive cycles, the substrate 10 is advanced so as to present the next region to be printed beneath the print head and the ribbon 2 is advanced so that an unused section of ribbon is located between the print head 7 and the substrate 10. Once again accurate transport of the ribbon 2 is necessary to ensure that unused ribbon is always located between the substrate 10 and print head 7 at a time that the print head 7 is advanced to conduct a printing operation. It will be appreciated that where the intermittent mode is used, a mechanism is provided to allow the print head 7 to be moved along a linear track so as to allow its displacement along the ribbon path. Such a mechanism is not shown in FIG. 1 but is described in our earlier U.S. Pat. No. 7,150,572 the contents of which are hereby incorporated by reference.

In general, during the transfer of tape from the supply spool 3 to the take up spool 4, both the supply spool motor 3*b* and the take-up spool motor 4*b* are energised in the same rotational direction. That is, the supply spool motor 3*b* is energised to turn the supply spool 3 to pay out an amount of tape while the take-up spool motor 4*b* is energised to turn the take-up spool 4 to take-up an amount of ribbon. The motors can therefore be said to operate in "push-pull" mode. Where tension in the ribbon is to be maintained, it is important that the linear quantity of ribbon paid out by the supply spool is essentially equal to the linear quantity of ribbon taken up by the take-up spool. The ribbon 2 is generally controlled so as to have a nominal tension $T_{nominal}$ during printing operations. Additionally, as noted above it is desirable to transport a predetermined linear distance of tape between spools. This requires knowledge of the diameters of the spools given that the drive is applied to the spools and the linear length of tape transferred by a given rotational movement of the spools will vary in dependence upon the spool diameters.

It will be appreciated that techniques are known for ensuring that control is maintained over the amount of ribbon 2 that is paid-out and taken-up by the spools 3, 4, for example, by reference to the diameters of the spools 3, 4. Knowledge of the diameters of the spools 3, 4 can be obtained by a number of known techniques. Such techniques are described in, for example, U.S. Pat. Nos. 5,921,689 and 7,150,572.

Figure 2:
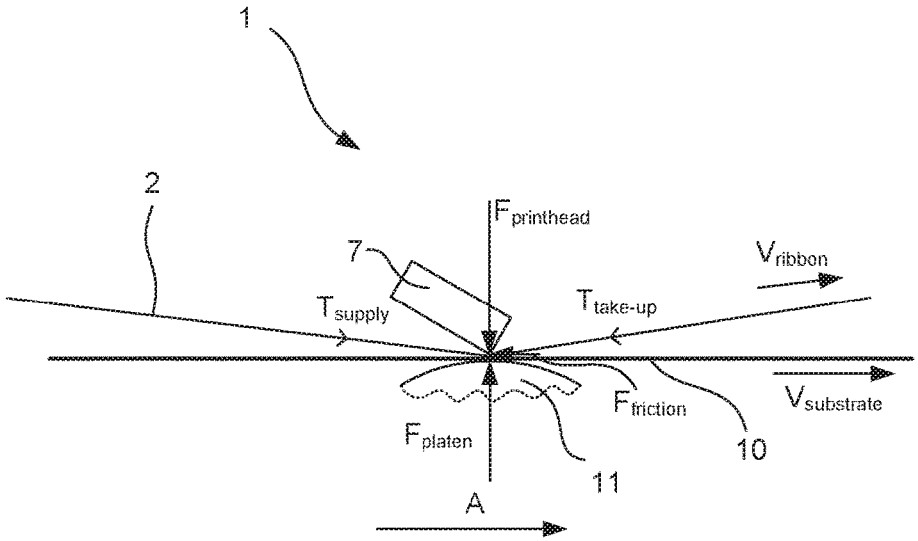
FIG. 2 is a schematic illustration of part of the thermal transfer printer of FIG. 1.

When the tension in the ribbon 2 is set by the control of the motors, the tension in the ribbon 2 is affected, during printing operations by the interaction between the printhead 7 and the ribbon 2. FIG. 2 illustrates some of the forces present in the printer 1 during a printing operation. The substrate 10 and ribbon 2 are moved past the printhead 7 in a direction A (which corresponds to the ribbon moving from the supply spool 3 to the take-up spool 4, as illustrated by FIG. 1). During a printing operation the printhead 7 is moved into contact with, and presses against the ribbon 2 with a printhead force $F_{printhead}$. The printhead force $F_{printhead}$ acts substantially perpendicular to the direction A. The printhead force $F_{printhead}$ is applied to the ribbon 2, the substrate 10, and the platen roller 11, which is supported so as to provide an opposite reaction force $F_{platen}$.

Friction between the ribbon 2 and both of the printhead 7 and the substrate 10 result in the tension in the ribbon 2 becoming different on either side of the printhead 7. That is, as the ribbon is moved towards the take-up spool 4, in the direction A, it will experience a frictional force $F_{friction}$ acting at the printhead in a direction opposite to the direction A. The result of this friction $F_{friction}$ is that the tension in the ribbon 2 on the take-up side of the printhead $T_{take\text{-}up}$ is increased with respect to the nominal tension $T_{nominal}$ by an amount equal to the frictional force $F_{friction}$. Conversely, the tension in the ribbon 2 on the supply side of the printhead $T_{supply}$ is reduced with respect to the nominal tension $T_{nominal}$ by an amount equal to the frictional force $F_{friction}$.

The ribbon 2 thus experiences differing tension on either side of the printhead 7. This difference in tension may result in the portion of tape having lower tension (i.e. on the supply side of the printhead) sagging, and possibly becoming folded or bunched. Such ribbon trauma can result in print quality degradation. For example, where ink ribbon 2 becomes folded, ink may not be properly transferred from the ribbon 2 to the substrate 10, resulting in regions of a printed image not being printed properly. Such ribbon trauma is especially common during the printing of long images, where there is an extended printing phase during which the printhead 7 is in contact with the ribbon 2.

Previously, it was understood that optimal printing was achieved when there was no relative movement between the substrate 10 and the ribbon 2 during printing operations (i.e. that ribbon and substrate speeds were substantially the same). However, it has been realised that print quality can be improved by reducing the speed of the ribbon 2 relative to the substrate 10. That is, in continuous printing, the ribbon 2 is controlled to move more slowly past the printhead 7 than the substrate 10, resulting in some relative movement between the ribbon 2 and the substrate 10, in addition to the relative movement between the substrate 10 and the printhead 7, and between the ribbon 2 and the printhead 7.

During a printing operation, and in particular at the point in time at which printing is carried out (i.e. when printing elements are energised), the substrate is moved past the printhead 7 in the direction A at a speed $V_{substrate}$. The ribbon 2 is moved past the printhead 7, in the direction A at a speed $V_{ribbon}$. However, rather than using the conventional control technique in which $V_{substrate}$ is equal to $V_{ribbon}$, the controller 9 controls the motors 3*b*, 4*b* to cause the ribbon speed $V_{ribbon}$ to be less than the substrate speed $V_{substrate}$.

Further, as described above, the interaction between the printhead 7 and the ribbon affects the tension in the portions of ribbon 2 either side of the printhead 7. As such, the magnitude of the printhead force $F_{printhead}$ is also be taken into account when determining what reduction in ribbon speed $V_{ribbon}$, relative to the substrate speed $V_{substrate}$, should be applied. In particular, the greater the printhead force $F_{printhead}$, the greater the reduction in ribbon speed $V_{ribbon}$ so as to compensate for the differences in tension on the supply side and take-up side of the printhead 7.

The printhead force $F_{printhead}$ may itself be varied in dependence on various printing parameters, such as, for example, the width of the printhead 7, and/or the width of the platen roller 11.

For example, a wider printhead 7 may require a greater printhead force $F_{printhead}$ to be applied than a narrower printhead 7 in order to generate the same contact pressure at the printhead-ribbon-substrate interface. As such, the printhead force $F_{printhead}$ and hence the ribbon speed $V_{ribbon}$, may be varied in dependence upon the printhead width. Similarly, a wider platen 11 may require a greater printhead force $F_{printhead}$ be applied to than a narrower platen 11 in order to generate the same contact pressure at the printhead-ribbon-substrate interface.

Where different sized printheads and platen rollers are used the contact area between the printhead and platen (and hence force required to be applied) will be determined by the narrower of the two. Each of the printhead 7 and platen roller 11 may, for example, be selected from standard sized components, having a width of, for example, 55 mm, 76 mm, or 110 mm. However, both printhead 7 and platen roller 11 need not have the same size. Therefore, the smaller of the printhead and platen widths is used to determine a print contact width, which is the contact width between the printhead 7 and platen roller 11, and thus the relevant width in determining the required printhead force.

Further, where the printhead force $F_{printhead}$ is varied in dependence on the substrate speed, the printhead force $F_{printhead}$ may be increased at higher substrate speeds in order to maintain print quality.

Further still, the printhead force $F_{printhead}$ may be varied in dependence upon a printing force parameter. For example, the printing force parameter may be set to a value between 0 and 100, having a default value of 50. The printing force parameter may be used to scale the printhead force $F_{printhead}$ within a predetermined range. For example, the parameter may be set based upon properties of the ribbon 2 and/or the substrate 10.

Figure 3:
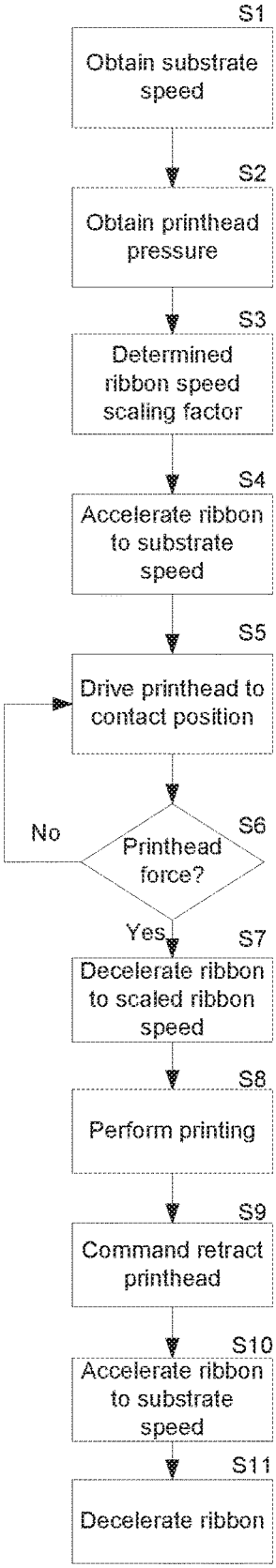
FIG. 3 is a flowchart showing processing carried out in the thermal transfer printer of FIG. 1 during printing operations.

FIG. 3 is a flowchart which shows processing carried out by the controller 9 in order to control the printer 1. At step S1 the controller 9 obtains the substrate speed $V_{substrate}$. The substrate speed $V_{substrate}$ may, for example, be obtained with reference to an encoder (e.g. a rotary encoder) which is arranged to generate an output signal indicative of the substrate speed $V_{substrate}$. Alternatively, the substrate speed $V_{substrate}$ may be obtained with reference to an expected or demanded substrate speed. For example, the obtained substrate speed $V_{substrate}$ may be based upon a control signal which is generated so as to control the movement of the substrate 10 (rather than being based upon the actual movement of the substrate 10).

Figure 4:
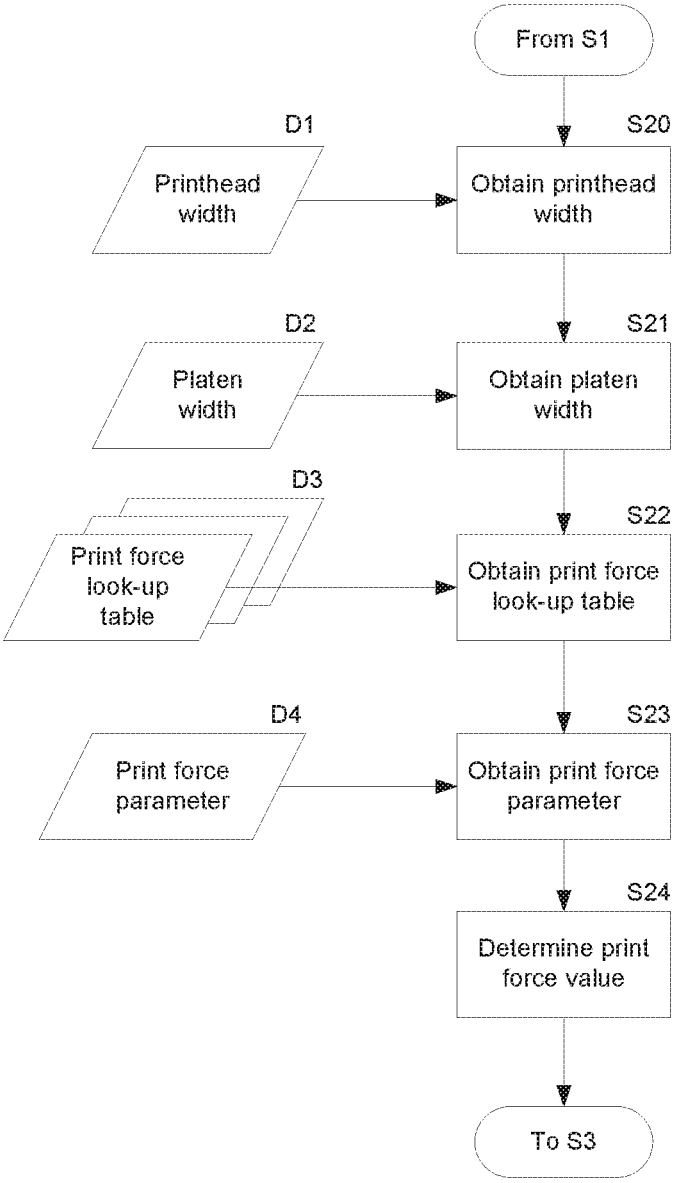
FIG. 4 is a flowchart showing processing carried out in the thermal transfer printer of FIG. 1 during printing operations.

Processing then passes to step S2 where the controller 9 determines the appropriate printhead force $F_{printhead}$ based upon the various parameters discussed above (as described in more detail below with reference to FIG. 4).

Processing then passes to step S3, where a ribbon speed scaling factor $f_v$ is determined based upon the printhead force $F_{printhead}$ with reference to a look-up table which is stored in a memory associated with the controller 9. The look-up table contains values of the scaling factor $f_v$ which correspond to different printhead forces $F_{printhead}$.

Table 1 shows an example of a look-up table which contains scaling factors for different printhead forces $F_{printhead}$.

TABLE 1

Scaling factor look-up table

| Printhead force (kg) | Ribbon speed scaling factor $f_v$ (%) | Inverse scaling factor $f_{inv}$ (%) | Ribbon image scaling factor $f_{ri}$ (%) |
|---|---|---|---|
| 0 | 100 | 100 | 100 |
| 1 | 99.11 | 100.91 | 100.6 |
| 2 | 98.81 | 101.21 | 100.91 |
| 3 | 98.62 | 101.42 | 101.11 |
| 4 | 98.33 | 101.73 | 101.32 |
| 5 | 97.85 | 102.25 | 101.83 |
| 6 | 97.37 | 102.77 | 102.35 |
| 7 | 96.90 | 103.31 | 102.77 |
| 8 | 96.43 | 103.84 | 103.31 |
| 9 | 95.97 | 104.38 | 103.73 |
| 10 | 95.51 | 104.93 | 104.28 |

The ribbon speed $V_{ribbon}$ is determined as a percentage of the substrate speed $V_{substrate}$. The value of the scaling factor $f_v$ determines the percentage, and is generally between 90 and 100%. The value of the scaling factor $f_v$ may, for example, be 99%. In such an arrangement, the ribbon speed $V_{ribbon}$ is determined to be 99% of the substrate speed $V_{substrate}$. Such a reduction in ribbon speed (i.e. a 1% reduction) may, for example, provide improved printing performance where a relatively narrow printhead, and/or a slow substrate speed $V_{substrate}$, and thus low printhead force $F_{printhead}$ is in use.

Further, the value of the scaling factor $f_v$ may, for example, be 98%, the ribbon speed $V_{ribbon}$ being 98% of the substrate speed $V_{substrate}$. Such a reduction in ribbon speed (i.e. a 2% reduction) may, for example, provide improved printing performance where a wider printhead, and/or a higher substrate speed $V_{substrate}$, and thus proportionally higher printhead force $F_{printhead}$ is in use.

Further, the value of the scaling factor $f_v$ may, for example, be 95%, the ribbon speed $V_{ribbon}$ being 95% of the substrate speed $V_{substrate}$. Such a reduction in ribbon speed (i.e. a 5% reduction) may, for example, provide improved printing performance where a wider printhead still and/or a faster substrate speed $V_{substrate}$, is in use.

The reduction in ribbon speed may be as much as 10%.

Once the ribbon speed $V_{ribbon}$ has been determined at step S3, processing passes to step S4 where the ribbon 2 is accelerated from rest so as to be driven at a speed which is equal to the substrate speed $V_{substrate}$ (which is a greater speed than the determined ribbon speed $V_{ribbon}$). That is, prior to the commencement of printing, and prior to contact being made between the printhead 7 and the ribbon 2, the scaling factor f is effectively set to 100% (regardless of the value determined at step S3), such that the substrate and ribbon speeds are equal.

Processing then passes to step S5, where the printhead 7 is moved towards the ribbon 2 at an appropriate time and printhead advance speed so as to arrive in a printing configuration at a time at which printing is required to be started). Once contact is made between the printhead 7 and the ribbon 2, the printhead 7 is further driven towards the ribbon 2 so as to generate the predetermined printhead force $F_{printhead}$.

At step S6, it is determined whether the predetermined printhead force $F_{printhead}$ has been achieved. If not, processing returns to step S5 where the printhead is further driven towards the ribbon so as to increase the force. If the predetermined printhead force $F_{printhead}$ has been achieved processing passes to step S7.

At step S7, the ribbon is driven at the determined ribbon speed $V_{ribbon}$. That is, the scaling factor is set to the value determined in processing step S3, and the ribbon is decelerated by an amount corresponding to the difference between the substrate speed $V_{substrate}$ and the ribbon speed $V_{ribbon}$. Given the relatively small change in speed, and this deceleration may occur in a very short period of time.

It has been realised that at the point of contact between the printhead 7 and the ribbon 2 (which causes the ribbon 2 to come into contact with the substrate 10), the ribbon 2 and the substrate 10 should be moving at substantially the same speed. Where there is a differential speed at the point of contact, scuffing may occur, resulting in some transfer of ink from the ribbon 2 to the substrate 10, even when no printing elements are energised. Such scuffing may result in a mark being left on the substrate, which may, for example, cause a subsequently printed barcode to be mis-read. Therefore, the ribbon speed is reduced relative to the speed of the substrate only when the printhead 7 is in contact with the ribbon 2, and pressing against the ribbon 2 with the predetermined printhead force $F_{printhead}$.

Processing then passes to step S8, where printing is carried out with the printhead force is at the level determined in step S2 (i.e. $F_{printhead}$), the substrate speed is at the level determined in step S1 (i.e. $V_{substrate}$), and the ribbon speed at the level determined in step S3 (i.e. $V_{ribbon}$), as scaled by the scaling factor $f_v$.

It will be appreciated that in some embodiments there may be a predetermined delay introduced between the printhead 7 reaching the print position (at step S5), and printing being carried out (at step S8), so as to ensure that any bounce caused by the mechanical movements has subsided before printing begins. An appropriate delay may, for example, be a time delay of 10 ms, or a delay which provides for 1 mm of ribbon movement.

Once printing has been carried out (for example after a plurality of lines have been printed) processing passes to step S9, where printhead is commanded to retract from the printing position. Processing then passes to step S10, where the scaling factor is once again set to 100%, and the ribbon 2 accelerated back to the substrate speed $V_{substrate}$.

At the point that the printhead 7 is disengaged from the ribbon 2 (i.e. the point at which contact is lost between the printhead 7 and the ribbon 2), processing passes to step S11.

At step S11, after contact is lost between the printhead 7 and the ribbon 2, the ribbon 2 is once again decelerated to rest (and any ribbon reversal operations are carried out as required to ensure the ribbon position is prepared for subsequent printing operations).

It will be appreciated that while the sequence of processes S9 and S10 may be as described above, mechanical response times of the various components within printer 1 may result in a change in ribbon speed occurring before, during or after a change in printhead force is brought about. However, it will be appreciated that at the point that contact is lost between the printhead 7 and the ribbon 2, the ribbon 2 and substrate 10 should be travelling at the same speed (i.e. with no relative speed to one another).

The processing of steps S1 to S11 is then repeated for subsequent printing cycles.

It will be appreciated that print speed may be updated during a printing cycle (i.e. the printing of an image). As such it may be beneficial to run additional processing during step S8 (printing) to determine an updated scaling factor. For example, in an embodiment, the processing steps S1 to S3, and S7 are run a plurality of times during the printing cycle.

Further, while it is described above that the scaling factor $f_v$ is applied only once the predetermined printhead force $F_{printhead}$ has been applied, in an embodiment the scaling factor may be gradually applied as the printhead force is increased. That is, between the point at which contact is made between the printhead and the ribbon, and the full predetermined printhead force being applied, the scaling factor may be applied proportionally to a printhead force applied at any given point in time, such that at any given point in time, an appropriate scaling factor is applied for the current printhead force. The appropriate scaling factor $f_v$ may be determined with reference to the lookup table shown in Table 1, and may be obtained by interpolating between scaling factor values when the printhead force is between table entries as necessary.

It will be appreciated that while it is described above that look-up table values contain scaling factors, in an embodiment, a look-up table may contain values for the ribbon speed $V_{ribbon}$ which correspond to different printhead force $F_{printhead}$ and substrate speed $V_{substrate}$ values.

In a further alternative, the appropriate ribbon speed scaling factor $V_{ribbon}$ may be determined based upon the substrate speed $V_{substrate}$ and the printhead force $F_{printhead}$ according to the following expression:

$$V_{ribbon}=f(F_{printhead})\cdot V_{substrate} \quad (1)$$

where $f(F_{printhead})$ is a function of the printhead force $F_{printhead}$.

Thus it can be seen that the ribbon speed $V_{ribbon}$ is determined as a proportion of the substrate speed $V_{substrate}$.

In some embodiments the processing described above with reference to FIG. 3 may be altered. For example, where printing is performed on a substrate 10 which is advanced intermittently (e.g. where the substrate 10 is a series of labels which are advanced so as to be applied to products on a product conveyor) the printhead 7 may be brought into contact with the substrate 10 whilst the substrate 10 is stationary (with respect to the printhead 7). That is, the processing described at steps S4 to S7 may be modified from that described above. In more detail, rather than accelerating the ribbon 2 to the substrate speed (step S4) prior to driving the printhead 7 to the contact position (step S5), and establishing the printhead force applied (step S6), the processing of steps S5 and S6 may be performed before the ribbon 2 is accelerated from rest. Then, once the printhead pressure has been established, the ribbon 2 is accelerated from stationary to the scaled speed (rather than the substrate speed). Printing can then take place while the ribbon 2 is transported at the scaled ribbon speed.

In some embodiments the acceleration of the ribbon 2 is triggered based upon an acceleration of the substrate 10. For example, the movement of the substrate may be detected by a linear encoder (or other suitable displacement sensor) and used to trigger the ribbon 2 to be accelerated.

Further, in some embodiments acceleration of the ribbon 2 is triggered based upon an anticipated or expected acceleration of the substrate 10. For example, where the substrate is controlled by a controller which is in communication with a controller of the ribbon drive, the ribbon 2 may be accelerated based upon a signal indicative of an expected substrate movement. In some circumstances such ribbon movement based upon an expected substrate movement enables improved print quality. For example, where ribbon 2 and substrate 10 are pressed together by the printhead 7 initial movement of the substrate 10 may be resisted by the resulting clamping force (i.e. the nip formed between the printing surface and the printhead 7), resulting in a delay between the commanded onset of movement and the actual onset of movement of the substrate 10, followed by a sudden acceleration of the substrate 10 when the nip force is overcome. Such a sudden acceleration may be difficult to match where ribbon acceleration is based upon detected substrate movement, resulting in a possible mismatch between ribbon and substrate movement, and a consequential reduction in print quality. However, by controlling ribbon movement based upon expected (or in this case commanded) substrate movement, it is possible for the ribbon to be controlled so as to more accurately match the substrate movement. In this way it is possible to reduce any negative consequences of sudden acceleration of substrate movement, such as reduced print quality.

It will be appreciated that when the printhead contacts the stationary ribbon, with the substrate also being stationary, the ribbon 2 and the substrate 10 are moving at substantially the same speed (i.e. zero) and consequently there is minimal risk of scuffing.

Further, when printing on a substrate 10 which is advanced intermittently, once the printing operation is complete, the ribbon 2 is decelerated to stationary in a single process (rather than being accelerated back up to the substrate speed, and then decelerated to stationary). That is, steps S10 and S11 described above may be replaced with a single step in which the ribbon 2 is decelerated to stationary from the scaled speed.

The processing described above at step S2 to determine the appropriate printhead force $F_{printhead}$ based upon the various parameters discussed above is now described in more detail with reference to FIG. 4.

At step S20, the printhead width is determined. This may, for example, be obtained with reference to printhead width data D1 stored within a memory associated with the processor 9. As described above the printhead may, for example, have a width of 55 mm, 76 mm, or 110 mm. Of course, alternative printhead widths are also possible.

Processing then passes to step S21, where the platen width is determined. This may, for example, be obtained with reference to platen width data D2 stored within a memory associated with the processor 9. As described above the platen may, for example, have a width of 55 mm, 76 mm, or 110 mm. Of course, alternative platen widths are also possible.

Processing then passes to step S22, where an appropriate print force look-up table is retrieved from a memory associated with the processor 9. A plurality of look-up tables D3 are stored within a memory associated with the controller 9, each look-up table D3 corresponding to a particular print contact width. As described above, print contact width is determined as the minimum of the platen and printhead widths. As such, a look-up table corresponding to the determined print contact width is obtained.

Each look-up table D3 contains printhead force values in kilograms, for a variety of print speeds and force settings. A standard printhead force value may, for example, be obtained by reference to a printhead datasheet. Alternatively, or additionally, a standard printhead force value may be obtained by experimentation. For example, a series of images (e.g. barcodes) may be printed at different printhead forces, and at a variety of print speeds, and the resulting printed images scanned to determine an appropriate printhead force value for each print speed. The appropriate printhead force value for each print speed may, for example, be the printhead force value which corresponds to the highest ANSI grade for a printed barcode, and may thus be selected as the standard printhead force value.

Each look-up table D3 may also contain a minimum printhead force value. The minimum printhead force value may, for example, correspond to a force below which ink is no-longer transferred from the ribbon to the substrate. The minimum printhead force value may additionally be obtained by experimentation.

Each look-up table D3 may also contain a maximum printhead force value. The maximum printhead force value may, for example, correspond to a force above which damage is likely to be caused to the printhead 7.

Once an appropriate print contact look-up table D3 has been obtained, processing passes to step S23, where a print force parameter D4 is obtained. As described above, the print force parameter D4 may be set to a value between 0 and 100, having a default value of 50.

Processing then passes to step S24, where the print force parameter D4 is used in combination with the print speed obtained at step S2, to determine an appropriate printhead force $F_{printhead}$ from the relevant look-up table D3. Where the print force parameter D4 is set to 0, the minimum print force is selected from the look-up table. Where the print force parameter D4 is set to 50 (which may be a default setting), the standard print force is selected from the look-up table. Where the print force parameter D4 is set to 100, the maximum print force is selected from the look-up table. Where the print force parameter D4 is between those values, the print force is selected by scaling between the values in the look-up table in proportion to the print force parameter (i.e. by interpolating between the look-up table values).

Processing then passes to step S3, where the determined printhead force is used to determine a ribbon speed scaling factor, as described above.

As described above, by running the ribbon 2 at a slower speed than the substrate 10, it is possible to improve print quality, by reducing the occurrence of ribbon sag, and subsequent ribbon trauma events. In addition, by running the ribbon 2 at a slower speed than the substrate 10 a further advantage over known techniques is that ribbon usage is reduced by an amount corresponding to the relative speed reduction. That is, for each image printed using the ribbon 2, the amount of ribbon 2 used will be less than the length of the image. Thus, significant ribbon savings of, for example 2-4%, and as much as 10%, may be realised by the method described above.

In some embodiments, the ribbon speed (as scaled by the ribbon speed scaling factor $f_v$) is provided as an input to a process running on the controller 9 known as a print engine. The print engine is arranged to control the energisation of the printing elements within the printhead 7, so as to cause printing at a desired location on the substrate 10. However, so as to ensure that the location corresponds to a correct substrate location (as determined by substrate speed, rather than ribbon speed) an inverse ribbon scaling factor fin, is applied to the ribbon speed, prior to it being provided to the print engine. This ensures that the image size on the substrate is correct, and is not scaled according to the ribbon speed scaling factor $f_v$. Example inverse ribbon scaling factor $f_{inv}$ values are provided in Table 1. Put another way, the printing of each image needs to be controlled based upon the speed of the substrate, such that, to the extent that printing is controlled based upon an input indicative of the speed of the ribbon, it should be scaled by a factor of the type described above.

Further, in addition to the processing described above, in some embodiments an additional ribbon image scaling factor $f_{ri}$ may be applied. The printing of each image results in a negative image being formed on the ribbon 2, where ink has been removed from the ribbon 2 and transferred to the substrate 10. Such a negative image may be referred to as a ribbon image. In conventional printing, a ribbon image is equal in size to the printing image on the substrate 10. However, where a ribbon speed scaling factor $f_v$ is used as described herein, the ribbon image is scaled according to the scaling factor (i.e. the ribbon image is smaller than the printed image). Such an approach still provides high quality printing due to the fact that during printing, at the printhead 7, the ribbon 2 is stretched.

So as to ensure that adjacent ribbon images do not overlap, the distance moved by the ribbon 2 during the printing of each image may be adjusted by a ribbon image scaling factor $f_{ri}$. That is, while the ribbon speed is reduced with respect to the substrate speed by the ribbon speed scaling factor $f_v$, as described above, the ribbon 2 may be advanced by an amount which corresponds to a different scaling factor, intermediate the ribbon speed scaling factor $f_v$, and a scaling factor of 100%. The ribbon image scaling factor $f_{ri}$ may also be retrieved from the look-up table at step S3, and used in subsequent processing to control the distance the ribbon 2 is advanced between consecutive printing cycles.

The print engine stores data indicative of the ribbon image, so as to control the advance of the ribbon 2. The scaled ribbon speed may be used to determine the expected ribbon image length. However, as described above with reference to the inverse scaling factor $f_{inv}$, a ribbon image scaling factor $f_{ri}$ may be an inverse scaling factor which is applied to the scaled ribbon speed so as to introduce a safety margin. For example where a ribbon speed scaling factor $f_v$ of 96% is used, a ribbon image having a size which is 96.4% of the printed image size may be used. As such, a small safety margin is introduced so as to prevent adjacent ribbon images from overlapping on the ribbon 2. Example ribbon image scaling factor $f_{ri}$ values are provided in Table 1.

It will be appreciated that each of the scaling factor values provided in Table 1 is an example of a scaling factor value which has been determined to provide an appropriate adjustment of the print speed/ribbon image in a particular printing system. However, it will also be appreciated that such scaling factor values may be altered as required.

Appropriate scaling factor values for a particular printing system may be determined by experimentation.

In an embodiment scaling factors may be applied to a single one of the two motors 3*b*, 4*b* which drive the spools 3, 4. Alternatively, different scaling factors may be applied to each of the motors 3*b*, 4*b*. It will be appreciated that where different scaling factors are applied (or where a scaling factor is only applied to a single one of the two motors 3*b*, 4*b*), for example by applying a greater scaling factor to the supply spool motor 3*b* than the take-up spool motor 4*b*, a different amount ribbon 2 may be fed by each of the spools 3, 4, possibly resulting in a gradual increase in tension within the ribbon 2. Such a tension increase may be monitored so as to ensure that the ribbon is not damaged. Further, where such a tension increase occurs, a take-up spool support may become crushed due to excessive ribbon tension.

Reference has been made above to the concept of print speed, being the speed of relative movement between the printhead and the substrate. This has, in some examples, been equated to substrate speed. This applies when printing is effected by a stationary printhead, past which ribbon and substrate are moved (so-called "continuous" printing). However the various techniques described herein apply equally when the substrate is held stationary and the printhead is moved relative to the stationary substrate (so-called "intermittent" printing). Here print speed is defined by the speed of movement of the printhead relative to the stationary substrate.

In more detail, in intermittent printing, the processing described above with reference to FIG. 3 may be modified so as to better reflect the requirements for intermittent printing. For example, in intermittent printing, the ribbon 2 will not be driven at the substrate speed and then decelerated to a scaled speed. Rather, in a printing operation, the printhead 7 will be brought into contact with the ribbon 2 whilst the ribbon 2 and substrate 10 are both stationary. Then, once the printing force is established, the printhead 7 is accelerated (with respect to the substrate) to the printing speed. At the same time as the printhead 7 is accelerated, the ribbon 2 is also accelerated so as to cause relative movement between the substrate 10 and the ribbon 2, such that the ribbon speed (i.e. the speed of relative movement between the ribbon 2 and the printhead 7) is different from the printing speed (i.e. the speed of relative movement between the substrate 10 and the printhead 7). Thus, while in continuous printing operations as described above with reference to FIG. 3, there will be relative movement between the ribbon 2 and the printhead 7 at the printing speed, this may never occur in intermittent printing. That is, relative movement between the ribbon 2 and the printhead 7 will only occur at the scaled speed.

Further, in intermittent printing, a scaling factor may be applied to only the supply spool motor 3*b*. In such an arrangement, the substrate 10, and take-up spool motor 4*b* may be held stationary during printing, while the printhead 7 is moved relative to the substrate 10. However, the supply spool motor 3*b* may be rotated in a backwards direction (i.e. to take-up ribbon 2) by an amount so as to ensure that any sag developed in the ribbon 2, as a result of friction between the printhead 7 and the ribbon 2, as the printhead 7 is moved relative to the ribbon 2, is reduced. In such an arrangement, the take-up spool motor 4*b* may be held stationary, so as to ensure that a sufficiently high tension is maintained in the take-up side of the ribbon 2, so as to maintain good ink peeling behaviour at the printhead peel-off point. That is, when the ribbon 2 is accelerated so as to cause relative movement between the substrate 10 and the ribbon 2, such that the ribbon speed (i.e. the speed of relative movement between the ribbon 2 and the printhead 7) is different from the printing speed (i.e. the speed of relative movement between the substrate 10 and the printhead 7), it is not necessary for both the supply spool motor 3*b* and the take-up spool motor 4*b* to be rotated. Rotation of just one motor (e.g. the supply spool motor 3*b*), as described above, may be considered to cause relative movement between the substrate 10 and the ribbon 2.

Reference has been made in the preceding description to the printer controller 9 and various functions have been attributed to the printer controller 9. It will be appreciated that the printer controller 9 can be implemented in any convenient way including as an application specific integrated circuit (ASIC), field programmable gate array (FPGA) or a microprocessor connected to a memory storing processor readable instructions, the instructions being arranged to control the printer and the microprocessor being arranged to read and execute the instructions stored in the memory. Furthermore, it will be appreciated that in some embodiments the printer controller 9 may be provided by a plurality of controller devices each of which is charged with carrying out some of the control functions attributed to the printer controller 9.

While various embodiments have been described above it will be appreciated that these embodiments are for all purposes exemplary, not limiting. Various modifications can be made to the described embodiments without departing from the spirit and scope of the present invention.

The invention claimed is:

1. A thermal transfer printer controller comprising circuitry arranged to control a thermal transfer printer comprising: first and second spool supports each being configured to support a spool of ribbon; a ribbon drive configured to cause movement of ribbon from the first spool support to the second spool support along a predetermined ribbon path; and a printhead, the printhead being moveable towards and away from a printing surface, and, during printing, being configured to selectively transfer ink from the ribbon to a substrate as the substrate and printhead are moved relative to one another at a print speed, the thermal transfer printer controller being configured to:

control the printer to cause relative movement between the ribbon and the printhead at a ribbon speed; and transmit a signal to the ribbon drive to control, during printing, a relative speed of movement between the ribbon and the substrate based upon:

a force exerted upon the ribbon by the printhead during a printing operation; and/or a parameter indicative of an area of contact between a portion of the printhead and a portion of the printing surface;

wherein the thermal transfer printer controller is further configured to determine data indicative of a magnitude of the force exerted upon the ribbon by the printhead and further configured to determine a magnitude of the relative speed of movement between the ribbon and the substrate based on the determined data indicative of the magnitude of the force.

2. The thermal transfer printer controller according to claim 1, wherein the circuitry comprises a memory storing processor readable instructions and a processor configured to read and execute instructions stored in said memory.

3. The thermal transfer printer controller of claim 1, wherein the relative speed of movement between the ribbon and substrate is based upon the force exerted upon the ribbon by the printhead during a printing operation, and wherein the ribbon speed is less than the print speed.

4. The thermal transfer printer of claim 3, wherein the ribbon speed is greater than or equal to about 90% of the print speed.

5. The thermal transfer printer of claim 4, wherein the ribbon speed is less than or equal to about 99% of the print speed.

6. A thermal transfer printer controller comprising circuitry arranged to control a thermal transfer printer comprising: first and second spool supports each being configured to support a spool of ribbon; a ribbon drive configured to cause movement of ribbon from the first spool support to the second spool support along a predetermined ribbon path; and a printhead, the printhead being moveable towards and away from a printing surface, and, during printing, being configured to selectively transfer ink from the ribbon to a substrate as the substrate and printhead are moved relative to one another at a print speed, the thermal transfer printer controller being configured to:

control the printer to cause relative movement between the ribbon and the printhead at a ribbon speed; and transmit a signal to the ribbon drive to control, during printing, a relative speed of movement between the ribbon and the substrate based upon:

a force exerted upon the ribbon by the printhead during a printing operation; and/or a parameter indicative of an area of contact between a portion of the printhead and a portion of the printing surface;

wherein the thermal transfer printer controller is configured to determine a magnitude of the force based on the parameter indicative of the area of contact.

7. The thermal transfer printer controller according to claim 6, wherein the parameter indicative of the area of contact comprises a value of a dimension of a component of the thermal transfer printer.

8. The thermal transfer printer controller according to claim 6, wherein the circuitry comprises a memory storing processor readable instructions and a processor configured to read and execute instructions stored in said memory.

9. The thermal transfer printer controller of claim 6, wherein the relative speed of movement between the ribbon and substrate is based upon the force exerted upon the ribbon by the printhead during a printing operation, and wherein the ribbon speed is less than the print speed.

10. A thermal transfer printer, comprising:

first and second spool supports each being configured to support a spool of ribbon;

a ribbon drive configured to cause movement of ribbon from the first spool support to the second spool support along a predetermined ribbon path;

a printhead, the printhead being moveable towards and away from a printing surface, and, during printing, being configured to selectively transfer ink from the ribbon to a substrate as the substrate and printhead are moved relative to one another at a print speed;

a controller configured to:

control the printer to cause relative movement between the ribbon and the printhead at a ribbon speed; and control, during printing, a relative speed of movement between the ribbon and the substrate based upon:

data indicative of a force exerted upon the ribbon by the printhead during a printing operation;

a parameter indicative of an area of contact between a portion of the printhead and a portion of the printing surface;

wherein the thermal transfer printer controller is further configured to determine the data indicative of a magnitude of the force exerted upon the ribbon by the printhead and further configured to determine a magnitude of the relative speed of movement between the ribbon and the substrate based on the determined magnitude of the force; and wherein the thermal transfer printer controller is configured to determine the magnitude of the force based on a value of the parameter indicative of the area of contact.

11. The thermal transfer printer according to claim 10, further comprising a memory storing processor readable instructions and a processor configured to read and execute instructions stored in said memory.

12. The thermal transfer printer of claim 10, wherein the relative speed of movement between the ribbon and substrate is based upon the force exerted upon the ribbon by the printhead during a printing operation, and wherein the ribbon speed is less than the print speed.

13. A thermal transfer printer controller comprising circuitry arranged to control a thermal transfer printer comprising: first and second spool supports each being configured to support a spool of ribbon; a ribbon drive configured to cause movement of ribbon from the first spool support to the second spool support along a predetermined ribbon path; and a printhead, the printhead being moveable towards and away from a printing surface, and, during printing, being configured to selectively transfer ink from the ribbon to a substrate as the substrate and printhead are moved relative to one another at a print speed, the thermal transfer printer controller being configured to:

control the printer to cause relative movement between the ribbon and the printhead at a ribbon speed; and transmit a signal to the ribbon drive to control, during printing, a relative speed of movement between the ribbon and the substrate based upon:

a force exerted upon the ribbon by the printhead during a printing operation; and/or a parameter indicative of an area of contact between a portion of the printhead and a portion of the printing surface;

wherein the thermal transfer printer controller is further configured to determine the magnitude of the print speed and further configured to control a magnitude of the relative speed of movement between the ribbon and the substrate based on the determined magnitude of the print speed.

14. The thermal transfer printer controller according to claim 13, wherein the thermal transfer printer controller is further configured to determine a magnitude of the force exerted upon the ribbon by the printhead during a printing operation based on the determined magnitude of the print speed.

15. The thermal transfer printer controller according to claim 14, wherein the magnitude of the force is increased based on an increase in the determined magnitude of the print speed.

16. The thermal transfer printer controller according to claim 13, wherein the circuitry comprises a memory storing processor readable instructions and a processor configured to read and execute instructions stored in said memory.

17. The thermal transfer printer controller of claim 13, wherein the relative speed of movement between the ribbon and substrate is based upon the force exerted upon the ribbon by the printhead during a printing operation, and wherein the ribbon speed is less than the print speed.

18. A thermal transfer printer controller comprising circuitry arranged to control a thermal transfer printer comprising: first and second spool supports each being configured to support a spool of ribbon; a ribbon drive configured to cause movement of ribbon from the first spool support to the second spool support along a predetermined ribbon path; and a printhead, the printhead being moveable towards and away from a printing surface, and, during printing, being configured to selectively transfer ink from the ribbon to a substrate as the substrate and printhead are moved relative to one another at a print speed, the thermal transfer printer controller being configured to:

control the printer to cause relative movement between the ribbon and the printhead at a ribbon speed; and transmit a signal to the ribbon drive to control, during printing, a relative speed of movement between the ribbon and the substrate based upon:

a force exerted upon the ribbon by the printhead during a printing operation; and/or a parameter indicative of an area of contact between a portion of the printhead and a portion of the printing surface;

wherein the thermal transfer printer controller is configured to transmit the signal to the ribbon drive to control the relative speed of movement based on a magnitude of the force exerted upon the ribbon by the printhead during the printing operation; and wherein the thermal transfer printer controller is configured to determine the magnitude of the print speed and further configured to determine the magnitude of the force based on the determined magnitude of the print speed.

19. The thermal transfer printer controller according to claim 18, wherein the circuitry comprises a memory storing processor readable instructions and a processor configured to read and execute instructions stored in said memory.

20. The thermal transfer printer controller of claim 18, wherein the relative speed of movement between the ribbon and substrate is based upon the force exerted upon the ribbon by the printhead during a printing operation, and wherein the ribbon speed is less than the print speed.

* * * * *